US008550751B2

(12) United States Patent
Fox

(10) Patent No.: US 8,550,751 B2
(45) **Date of Patent: *Oct. 8, 2013**

(54) NON-TENSIONABLE CABLE BOLT APPARATUS AND RELATED METHOD

(75) Inventor: William G. Fox, White Plains, KY (US)

(73) Assignee: DSI Underground Systems, Inc., Martinsburg, WV (US)

( * ) Notice: Subject to any disclaimer, the term of this patent is extended or adjusted under 35 U.S.C. 154(b) by 413 days.

This patent is subject to a terminal disclaimer.

(21) Appl. No.: 12/849,115

(22) Filed: Aug. 3, 2010

(65) Prior Publication Data

US 2011/0027019 A1 Feb. 3, 2011

Related U.S. Application Data

(60) Provisional application No. 61/230,841, filed on Aug. 3, 2009.

(51) Int. Cl.
*E21D 20/02* (2006.01)

(52) U.S. Cl.
USPC ..... 405/302.2; 405/259.5; 405/259.1

(58) Field of Classification Search
USPC ..... 405/259.1, 259.5, 259.6, 302.2
See application file for complete search history.

(56) References Cited

U.S. PATENT DOCUMENTS

| | | | | |
|---|---|---|---|---|
| 2,667,037 | A | 1/1954 | Thomas et al. | |
| 3,077,809 | A | 2/1963 | Harding et al. | |
| 3,896,627 | A | 7/1975 | Brown | |
| 3,901,039 | A | 8/1975 | Lundkvist | |
| 4,472,088 | A | 9/1984 | Martin | |
| 5,259,703 | A * | 11/1993 | Gillespie | 405/302.2 |
| 5,297,900 | A | 3/1994 | Witzand | |
| 5,344,256 | A | 9/1994 | Hedrick | |
| 5,441,372 | A | 8/1995 | Wilkinson | |
| 5,458,442 | A | 10/1995 | Ashmore | |
| 5,531,545 | A | 7/1996 | Seegmiller et al. | |
| 5,586,839 | A | 12/1996 | Gillespie | |
| 5,624,212 | A | 4/1997 | Gillespie | |
| 5,721,047 | A | 2/1998 | Thicthener et al. | |
| 5,785,463 | A | 7/1998 | Eaton et al. | |
| 5,829,922 | A | 11/1998 | Calandra, Jr. et al. | |
| 5,919,006 | A | 7/1999 | Calandra, Jr. et al. | |
| 5,954,455 | A | 9/1999 | Eaton et al. | |
| 6,074,134 | A | 6/2000 | Stankus et al. | |
| 6,296,429 | B1 | 10/2001 | Wright | |
| 6,402,433 | B1 | 6/2002 | Gillespie | |
| 6,428,243 | B1 | 8/2002 | Hutchins | |
| 6,561,721 | B2 * | 5/2003 | Lausch et al. | 405/302.2 |
| 6,612,783 | B2 * | 9/2003 | Stankus et al. | 405/259.5 |
| 6,626,610 | B1 | 9/2003 | Seegmiller | |
| 6,637,980 | B2 | 10/2003 | Robertson, Jr. | |
| 6,709,213 | B2 | 3/2004 | Bailey | |
| 6,820,657 | B1 | 11/2004 | Hedrick | |

(Continued)

FOREIGN PATENT DOCUMENTS

| | | |
|---|---|---|
| WO | WO 2005/012691 | 2/2005 |

*Primary Examiner* — Frederick L Lagman
(74) *Attorney, Agent, or Firm* — Ohlandt, Greeley, Ruggiero & Perle, L.L.P.

(57) ABSTRACT

A cable bolt and related methods are provided. In one aspect of the invention, the bolt includes a sleeve for connecting or securing to a cable. A plurality of facets along a peripheral portion of the sleeve create corners that prevent the cable from rotating within the borehole during installation. The sleeve may he secured to the cable using resin.

17 Claims, 5 Drawing Sheets

(56) References Cited

U.S. PATENT DOCUMENTS

| | | | | |
|---|---|---|---|---|
| 7,536,754 | B2 | 5/2009 | Campbell et al. | |
| 7,896,581 | B2 * | 3/2011 | Fox | 405/259.5 |
| 2003/0185632 | A1 | 10/2003 | Seegmiller | |
| 2003/0219316 | A1 | 11/2003 | Rataj | |
| 2005/0158127 | A1 | 7/2005 | Fergusson | |
| 2005/0208829 | A1 | 9/2005 | Campbell | |
| 2009/0067932 | A1 * | 3/2009 | Fox | 405/302.2 |
| 2011/0142549 | A1 * | 6/2011 | Fox | 405/259.5 |

* cited by examiner

NON-TENSIONABLE CABLE BOLT APPARATUS AND RELATED METHOD

This application claims the benefit of U.S. Provisional Patent Application Ser. No. 61/230,841, filed date Aug. 3, 2009 the disclosure of which is incorporated herein by reference.

TECHNICAL FIELD

The following technology relates generally to supporting a face of a passage in a geological structure and, more particularly, to a cable bolt apparatus and related methods.

BACKGROUND OF THE INVENTION

In recent decades, numerous proposals have been made for providing in situ support for the face of a passage in a geological structure, such as the roof in an underground mine. A typical arrangement employs an anchor, such as an elongated roof "bolt," that extends into a borehole formed in the face and is grouted in place. Federal regulations pertaining to underground mine safety require the placement of these bolts at frequent intervals throughout the mine passage. Consequently, ease of manufacture and use, as well as reliability, are important considerations in terms of reducing the overall installation cost to the mine owner (which, of course, directly correlates to the profitability of the mining operation).

Currently, a popular approach for roof support is the so-called "cable bolt." This type of bolt comprises a length of flexible metal cable inserted into the borehole and grouted in place, and may be either "passive" or tensionable. In one tensionable version, the bolt includes an externally threaded tension head including opposed, longitudinally extending anti-rotation keys for engaging the sidewalls so as to prevent rotation (see, e.g., U.S. Pat. No. 3,077,809 to Harding et al.). To tension the bolt, an associated nut is advanced against a support surface, such as a plate, which serves to engage the corresponding face in the desired fashion.

Despite the popularity of the basic tensionable approach over the years, several basic limitations remain. For one, the strata adjacent the mine passage settle or shift over time, which may cause a change in the tension originally applied during the initial installation. Likewise, the bolt over time may experience a loss in tension due to factors such as relaxation or creep. Nevertheless, most existing approaches cannot undergo re-tensioning in any reliable fashion after the initial installation.

Additionally, the current approach for installing tensionable cable bolts can lead to undesirable "false" tensioning and deleterious "kick back." Specifically, the cable may continue to twist within the borehole upon the application of torque. This can lead the installer to believe that the applied torque tensions the cable bolt, when in fact it is simply causing it to twist (and thus the moniker, "false" tensioning). In some circumstances, this twisting can even cause the bolt to counter-rotate, or "kick back," upon release of the accumulated energy, which is undesirable for obvious reasons.

Accordingly, a need exists for an improved bolting apparatus. Specifically, the bolt should be easy and inexpensive to manufacture and install, without the need for bulky castings that would extend below the roof line. The bolt would be also provide secure, reliable support for the adjacent strata once installed.

SUMMARY OF THE INVENTION

One aspect of the disclosure pertains to an apparatus for passively supporting a face of a mine passage in association with a cable for positioning in a borehole formed in the face of the mine passage. The apparatus comprises an elongated sleeve including an internal bore having an open end for receiving the cable and a plurality of facets along a peripheral portion forming at least two corners spaced apart a distance greater than a diameter of the borehole. Resin within the bore is provided for connecting the cable to the sleeve.

In one embodiment, the sleeve is adapted to engage an oversized portion of the cable. Preferably, the sleeve includes a plurality of facets arranged to provide the peripheral portion with a cross section forming a regular polygon. The sleeve may include a portion adapted to be positioned external to the borehole once installed, with this external portion lacking any external threads. Preferably, the sleeve further includes a flange having a face adapted for engaging a support surface adjacent the borehole when a portion of the sleeve including the corners is positioned in the borehole. The sleeve may also include a head adjacent the flange, said head adapted for engaging a structure for use in installing the sleeve in the borehole. In any case, the sleeve most preferably lacks threading for use in tensioning the cable in the borehole. The sleeve may also include a closed end opposite the open end, with the closed end forming an endwall of the bore.

A related aspect of the disclosure relates to a method of forming a bolting apparatus for insertion in a borehole formed in a mine passage. The method comprises providing a sleeve including a bore for receiving an oversized portion of a cable, the sleeve lacking threading for use in tensioning the bolting apparatus, and inserting the sleeve at least partially into the borehole.

The method may further include the step of providing the sleeve with resin for securing the oversized portion of the cable within the sleeve. The securing step may include the step of injecting a two-component resin into the bore adjacent the oversized portion of the cable. The method may further include the step of mechanically connecting the cable to the sleeve.

The method may comprise the step of providing the sleeve having a dimension in at least one direction that is greater than a diameter of the borehole. Preferably, the inserting step comprises engaging the sleeve engages one or more sides of the borehole Another aspect of this disclosure is concerned with a method of providing passive support for a face of a mine passage. The method comprises providing a bolting apparatus including a sleeve having a bore with an open end adapted for receiving an oversized portion of a cable, said bore including, resin; and after the delivering step, installing the sleeve at least partially within the borehole without applying tensioning to the bolting apparatus.

The inserting step may comprise engaging the sleeve with one or more sides of the borehole. Preferably, the sleeve includes a flange, and the installing step comprises engaging the flange with a support surface adjacent adjacent the borehole. The method may further include the step of providing the sleeve having a closed end forming an endwall of the bore.

These and other aspects of the present invention will become readily apparent to those skilled in this art from the following description wherein there is shown a preferred embodiment simply by way of illustration of one of the modes best suited to carry out the invention. As it will be realized, the invention is capable of other different embodiments and it several details are capable of modification in various, obvious aspects all without departing from the invention. Accordingly, the drawings and descriptions will be regarded as illustrative in nature and not as restrictive.

BRIEF DESCRIPTION OF THE DRAWING FIGURES

The accompanying drawings incorporated in and forming a part of the specification, illustrate several aspects of the present invention, and together with the description serve to explain certain principles of the invention. In the drawings:

FIG. 1 is a side view of a cable bolt apparatus forming, one aspect of the invention;

FIGS. 2*a*, 2*b*, and 2*c* are side cross-sectional, bottom, and top views of a sleeve forming part of the cable bolt apparatus of FIG. 1;

FIG. 3 is a partially cutaway side cross-sectional view of the sleeve-cable interface;

FIG. 3*a* is a cross-sectional view taken along line 3*a*-3*a* of FIG. 3;

FIG. 3*b* is a cross-sectional view taken along line 3*b*-3*b* of FIG. 3;

Reference is now be made in detail to the preferred embodiments of the invention, an example of which is illustrated in the accompanying drawings.

DETAILED DESCRIPTION OF THE INVENTION

Figure 1:
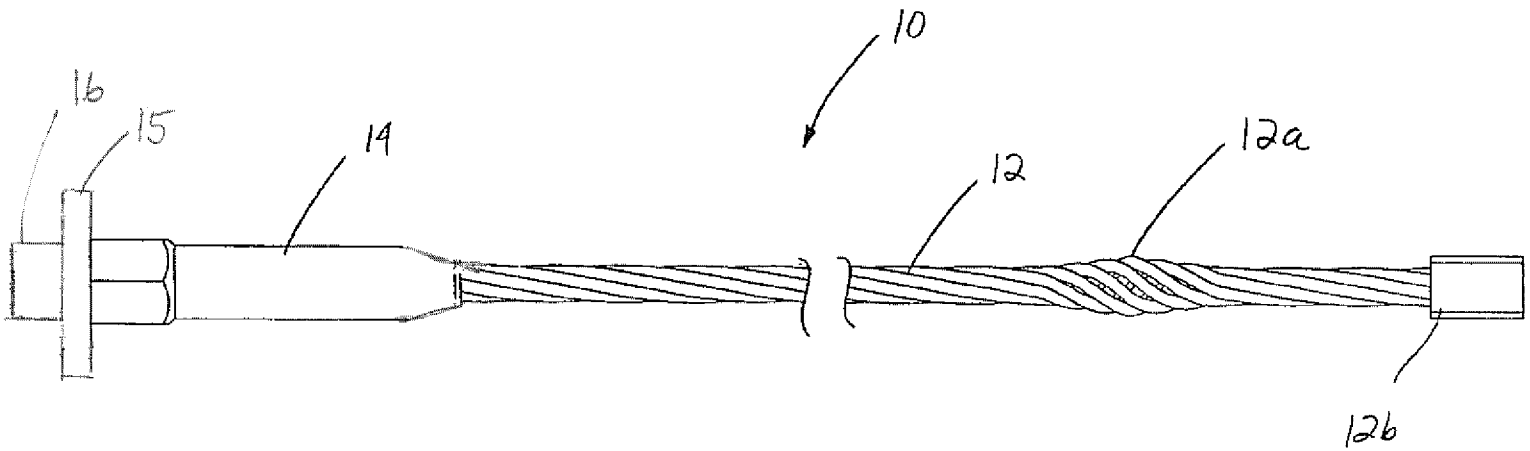

Reference is now made to FIG. 1, which illustrates one embodiment of a cable bolt apparatus, or bolt 10 for short. The bolt 10 as shown is intended for installation in a face F of a mine passage, such as the roof, having a borehole H formed therein (see FIGS. 4-5). Although the bolt 10 and related installation method are described as being used to reinforce and sustain a mine roof defined by an adjacent stratum S (or strata, as the case may be) in which the borehole H is vertically formed (see FIGS. 4-5), it should be understood that the present invention may be applied to support any one of the other faces of the passage (e.g., a rib) or a different type of geological structure, without limitation.

As illustrated, the bolt 10 is preferably an elongated structure comprising a length of multi-strand, flexible, metal cable 12. The cable 12 is adapted to fit within the borehole H while leaving an annulus A for receiving the resin or grout G used to secure it in place (see FIGS. 4-5). The cable 12 may be of any conventional type, such as that made by spirally wrapping a plurality of wire strands around a center wire.

The cable 12 also includes at least one, and preferably a plurality of enlarged or oversized portions. In the embodiment of FIG. 1, the enlarged or oversized portion is shown as comprising a "bulb" anchor or "bird cage" 12*a* formed in the cable 12, such as in the manner described in U.S. Pat. Nos. 5,344,256, 6,820,657, and International Application Publication No. WO/2005012691 (the disclosures of which are all incorporated herein by reference). However, other techniques for enlarging a portion of the cable 12 may be used instead, including through the use of sleeves for receiving some or all of the strands or the provision of a "nut cage" or the like. The particular manner of enlarging a portion of the cable 12 is considered unimportant to the practice of the invention.

The distal end of the cable 12 may also include a receiver 12*b*. As is known in the art, this receiver 12*b* may be swaged to the cable 12, thus defining wings 12*c*. The receiver 12*b* thus not only serves to receive and hold the ends of the strands forming the cable 12 together, but by virtue of the wings 12*c*, also helps to mix the uncured resin or grout G within the borehole H during installation of the bolt 10.

Figures 2A, 2B, 2C:
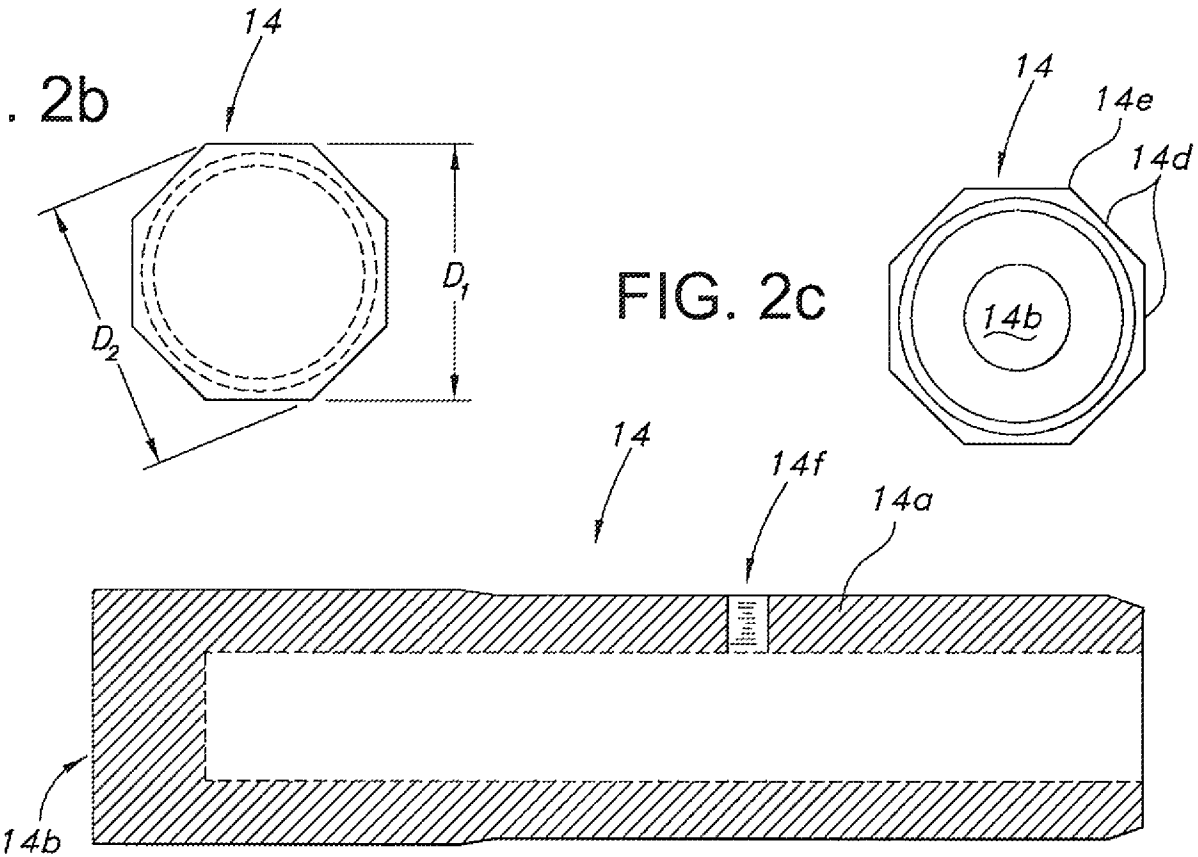

At a first, lower end, the cable 12 is secured to a sleeve 14. Turning now to FIGS. 2*a*-2*c*, one embodiment of the sleeve 14 forming one aspect of the present invention is shown in more detail. Specifically, the sleeve 14 is preferably formed of a single piece of material (such as a metal casting) having an elongated body 14*a* with an internal passage or bore 14*b*. This bore 14*b* is closed at one end by an endwall of the sleeve 14, as shown, and is generally of a substantially constant inner diameter.

At the opposite end, the sleeve 14 includes a flange 15. Connected adjacent to this flange 15 is a head 16 for driving the bolt 10, which may be square in cross section or otherwise adapted to engage a wrench or tool for purposes of imparting rotation during installation so as to mix the resin in the borehole.

The sleeve 14 also includes a peripheral portion having a plurality of flats or facets 14*d* that together create corners 14*e*. Specifically, each pair of adjacent facets 14*d* meet and form a corner 14*e* along the first or lower end of the sleeve 14. Preferably, at least five facets 14*d* are provided, which thus creates five corners 14*e*. In the most preferred embodiment, six facets 14*d* are provided, thus giving this portion of the sleeve 14 a generally hexagonal cross section (FIGS. 2*b* and 2*c*). However, it is possible to provide more or fewer facets 14*d*, which would thus result in a corresponding change in the cross section (e.g., three facets would make a triangle, four facets would make a square, eight facets would make an octagon, etc.).

FIGS. 2*b* and 2*c* illustrate that, when the sleeve 14 is provided with a cross section forming a regular polygon, the distance $D_1$ from any two opposed facets 14*d* is preferably smaller than the diameter M of the borehole H into which the sleeve 14 is to be inserted. However, the distance $D_2$ from opposed corners 14*e* is preferably at least equal to or slightly greater than the diameter of the borehole H. As will be better understood upon reviewing the description that follows, these corners 14*e* when so spaced apart provide the sleeve 14 with an oversized lower portion that helps the bolt 10 to resist rotation once placed in the borehole H.

Figure 3:
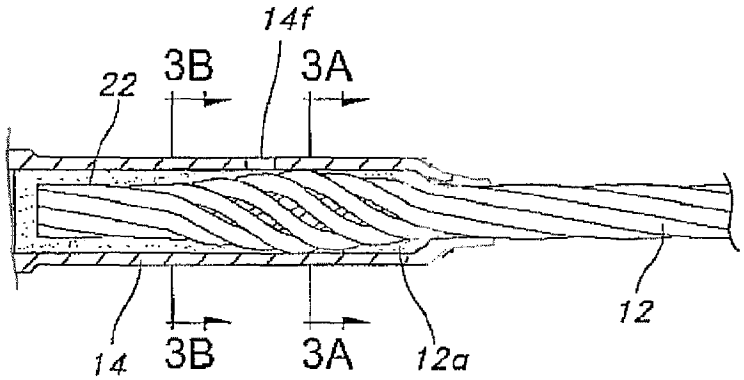
Figure 3B:
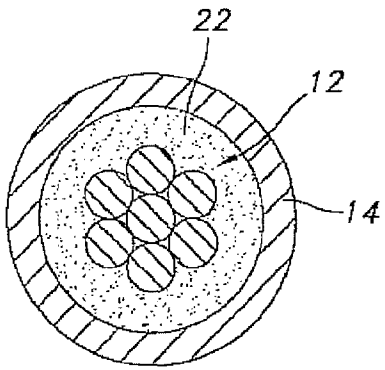
Figure 3A:
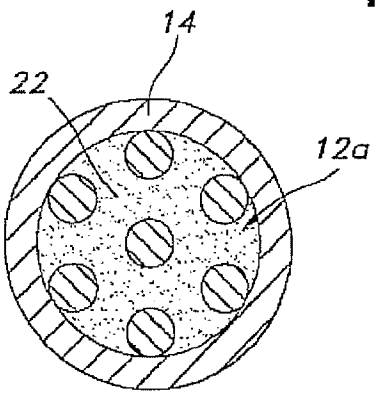

Turning now to FIGS. 3*a*-3*c*, one manner of connecting the cable 12 to the sleeve 14 in accordance with a preferred embodiment is disclosed. The cable 14 is inserted into the open end of the sleeve 14 until an enlarged or oversized portion (e.g., bulb 12*a*) along the proximal end is received in the bore 14*b*. The end of the sleeve 14 adjacent the interface with the opening of the bore 14*b* and the cable 12 is then mechanically connected to form a relatively secure connection between the two structures. This connection may be established by welding, swaging, threading, or like techniques.

With the cable 12 in this position, resin 22 is injected from a source into the portion of the bore 14*b* including the oversized portion of the cable 12, or bulb 12*a* in the illustrated embodiment. Preferably, the resin 22 is injected through a transverse passage or channel 14*f* in the sleeve 14 and communicating with the bore 14*b* (see FIG. 2 also). However, it is also possible to supply the resin 22 though the open end of the bore 14*b* prior to performing the swaging operation or otherwise connecting the sleeve 14 to the cable 12 in a mechanical fashion.

The resin 22 used to connect the cable 12 to the sleeve 14 may be of the two component variety, including a polyester component and a catalyst paste that, upon mixing, cure and harden in a matter of seconds (and sometimes called "grout" in the vernacular). The resin 22 used for this purpose may thus be similar or identical to that used to anchor the cable 12, but preferably has a higher viscosity to ensure that it remains within the bore 14*b* once injected. A suitable resin for this purpose is available from Minova International Ltd.

Regardless of the precise type of resin used or manner of injection, and as perhaps best understood by viewing FIGS. 3*b* and 3*c*, the resin 22 surrounds the cable 12. Specifically, the resin 22 penetrates into the bulb 12*a*, if present, surrounding each individual wire (see cross-section of FIG. 3*b*). Upon curing and hardening, the resin 22 thus serves to form a cement-like bond that not only connects the cable 12 to the sleeve 14 in a most reliable and secure fashion, but also resists any relative rotation.

Figure 4:
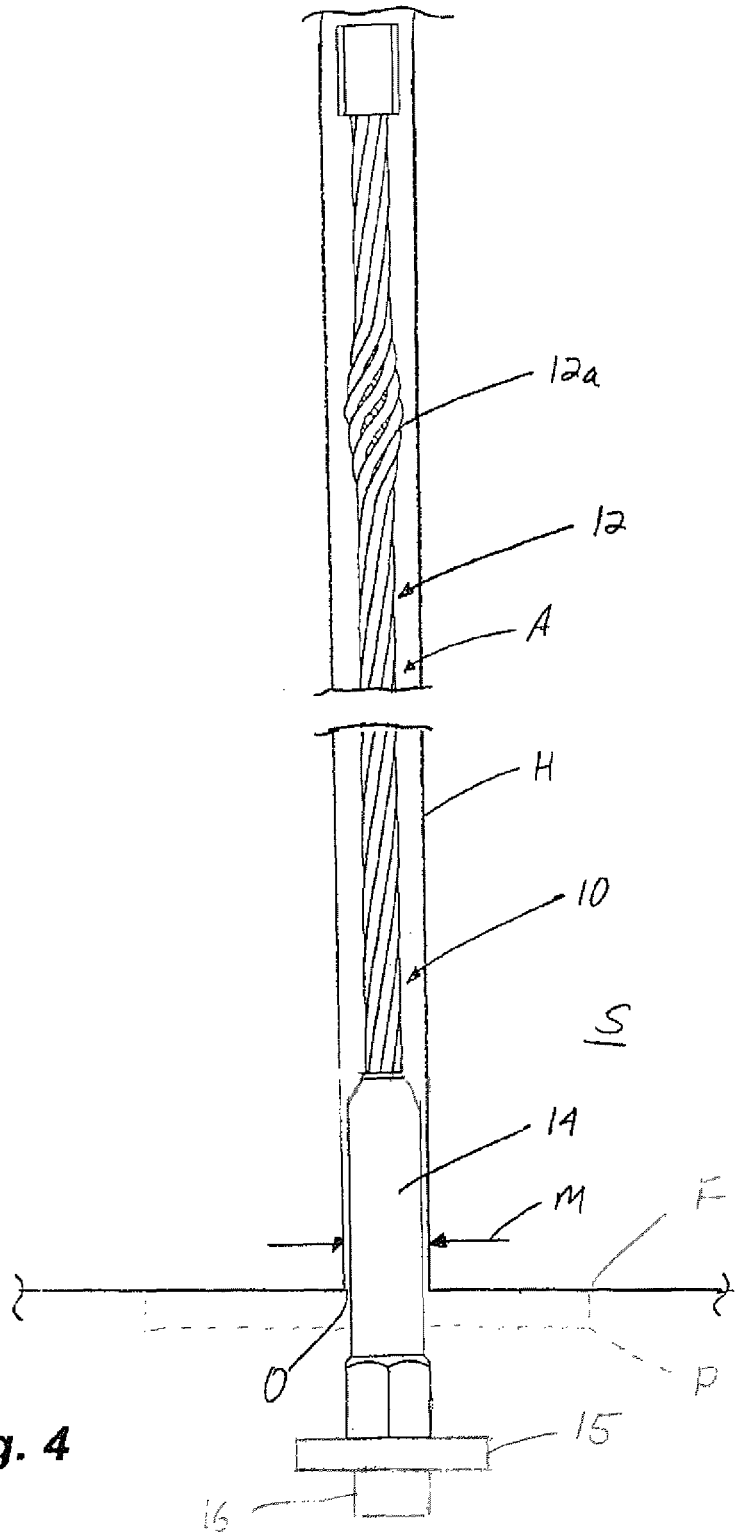
FIG. 4 is a side schematic view of the cable bolt apparatus partially inserted in a borehole in a mine passage.
Figure 5A:
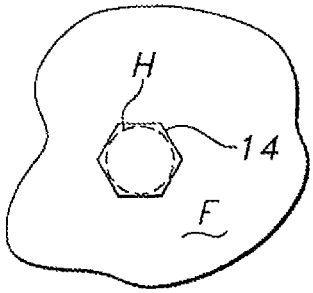
FIG. 5*a* is a partially cross-sectional bottom view taken along line 5*a*-5*a* of FIG. 5.
Figure 5:
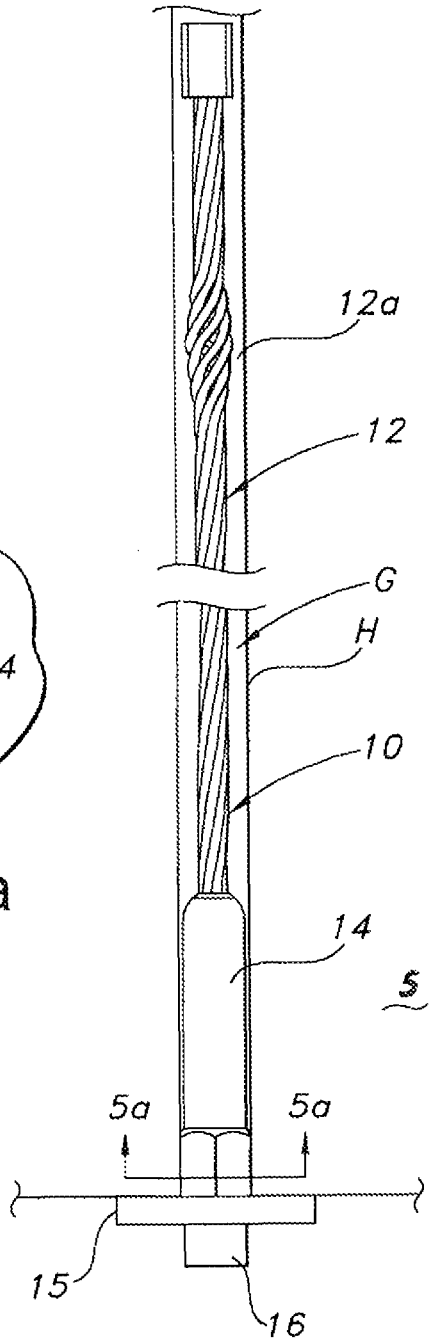
FIG. 5 is a side schematic view similar to FIG. 4, but showing the enlarged portion of the sleeve inserted within the borehole.

Reference is now made to the progressive views of FIGS. 4-5 which although not drawn to scale, illustrate schematically the manner in which the bolt 10 of FIG. 1 is installed in the borehole H. Specifically, the distal end of the cable 12 is inserted through the opening O of the borehole H, which is preferably formed having a diameter M matching the distance $D_1$ across the plurality of facets 14*d* of the sleeve 14 (e.g., 1.375 inch distance $D_1$ for a 1.375 inch diameter borehole, which thus makes the opposed corner-to-corner distance $D_2$ about 1.6 inches). The borehole H also preferably has a depth slightly greater than the bolt 10, such as by at least one inch and possibly more.

Using a lift boom associated with a bolting machine (not shown) or like structure, the bolt 10 with the cable 12 is advanced into the borehole H such that at least the lower end of the sleeve 14 remains spaced from the adjacent face F and the portion including the facets 14*d* does not yet enter the opening O. Although FIG. 4 shows the sleeve 14 partially inserted within the borehole H, the entire sleeve 14 may initially remain outside of the borehole H while the cable 12 is advanced. The advancing is preferably done in a relatively slow, controlled fashion in an effort to prevent the cable 12 from binding or hanging within the borehole H.

Once the bolt 10 is partially inserted in this fashion, uncured resin or grout G is provided adjacent to at least a portion of the cable 12 in the associated annulus A (see FIG. 5). Most preferably, the uncured resin or grout G is provided such that it occupies at least the annulus A adjacent the tail or distal end of the bolt 10, and in the upper portion of the borehole H.

Although this uncured resin may be provided from a remote source, such as by way of injection, it is most preferably supplied in the form of a frangible cartridge (not shown), or resin "sausage" in the vernacular. If this type of cartridge is used, it is normally pre-installed in the borehole H and ruptured during insertion of the cable 12, thus causing a quick-curing resin to occupy the surrounding borehole H. This grout G or resin also usually comprises two materials (e.g., polyester resin and a catalyst) that make contact and react only upon the rupturing of the cartridge. Upon being thoroughly mixed, such as by the rotation of the cable 12 within the borehole H (with any associated structures providing a mixing-assist function), the resin or grout G then quickly hardens. The hardened product thus serves to hold the cable 12 securely within the borehole H, and enables the resulting bolt 10 to resist movement in the longitudinal direction.

After mixing, but before the resin or grout G completely hardens (which, again, may take only a matter of seconds depending on the particular composition used), the bolt 10 is further advanced into the borehole H (FIG. 5), such as by using the lift boom of the associated bolter. This causes the corners 14*e* forming the oversized portion of the sleeve 14 to engage the adjacent strata S (FIG. 5*a*) and essentially form grooves in it. As a result of these corners 14*e* and the associated facets 14*d*, the bolt 10 securely and reliably resists rotation within the borehole H, and also creates a substantial seal to forestall the uncured resin or grout G from leaking. Once the resin sets or cures (which normally takes only seconds after mixing is complete), the bolt 10 is thus held securely within the borehole H and against rotation and movement in the axial or longitudinal direction as well.

Numerous advantages may thus arise from the use of the above-described bolt 10 and the associated installation technique. First of all, the ability of the cable bolt 10 when installed in this fashion to resist the undesirable twisting within the hole H during installation eliminates the deleterious kick back prevalent with prior art arrangements. A more reliable installation thus results, with the installer knowing that the bolt is securely anchored in place.

Secondly, the combined use of a sleeve 14 entirely inserted into the borehole H eliminates the need for bulky castings or assemblies projecting from the mine face F, such as the roof line (see, e.g., U.S. Pat. No. 6,637,980 to Robertson, Jr. and U.S. Pat. No. 6,626,610 to Seegmiller). This can be especially important in situations where the overhead is small due to a relatively low seam height.

Further, it should be appreciated that the bolt 10 need not be tensioned. Hence, as illustrated, the sleeve 14 does not include an external or internal threads for receiving a threaded shank or the like. Furthermore, there is no need for a tension nut or like structure to impart externally applied tensioning to the cable once installation is completed. This not only reduces cost, but also makes the installation much less complex.

Besides the enlarged or oversized portion within the sleeve 14, it should be appreciated from FIG. 1 that other enlarged portions may be provided along the entire length of the cable 12, This may be accomplished in any known manner, including those described in the above-referenced '256 and '657 patents. Most preferably, any enlargement is done after the cable 12 is coupled to the sleeve 14 in the manner described.

Preferably, the sleeve 14 comprises a relatively malleable metal, such as ductile steel. This allows for the sleeve 14 to be more easily swaged to the cable 12 adjacent the open end.

The foregoing description of embodiments of the present invention has been presented for purposes of illustration and description. It is not intended to be exhaustive or to limit the invention to the precise form disclosed. Obvious modifications or variations are possible in light of the above teachings. For instance, as shown in phantom view in FIG. 4, it is possible and desirable to position a plate P between the upper surface of the peripheral flange 15 and the strata S during installation (with this flange thus essentially forming a washer for engaging the support surface of the plate). The present embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention.

The invention claimed is:

1. An apparatus for passively supporting a face of a mine passage in association with a cable for positioning in a borehole formed in the face of the mine passage, comprising: an elongated sleeve including an internal bore having an open end for receiving the cable and a plurality of facets along a peripheral portion forming at least two corners spaced apart a distance greater than a diameter of the borehole; and resin within the bore for connecting the cable to the sleeve; wherein the sleeve includes a flange having a face adapted for engaging a support surface adjacent the borehole when a portion of the sleeve including the corners is positioned in the borehole.

2. The apparatus of claim 1, wherein the sleeve is adapted to engage an oversized portion of the cable.

3. The apparatus of claim 1, wherein the sleeve includes a plurality of facets arranged to provide the peripheral portion with a cross section forming a regular polygon.

4. The apparatus of claim 1, wherein the sleeve includes a portion adapted to be positioned external to the borehole once installed, said external portion lacking any external threads.

5. The apparatus of claim 1, wherein the sleeve further includes a head adjacent the flange, said head adapted for engaging a structure for use in installing the sleeve in the borehole.

6. The apparatus of claim 1, wherein the sleeve includes a closed end opposite the open end, said closed end forming an endwall of the bore.

7. The apparatus of claim 1, wherein the sleeve lacks threading for use in tensioning the cable in the borehole.

8. A method of forming a bolting apparatus for insertion in a borehole formed in a mine passage, comprising: providing a sleeve including a bore for receiving an oversized portion of a cable, said sleeve lacking threading for use in tensioning the cable in the borehole; and inserting the sleeve at least partially into the borehole; wherein the sleeve includes a flange having a face adapted for engaging a support surface adjacent the borehole when a portion of the sleeve including corners is positioned in the borehole.

9. The method of claim 8, wherein the providing step comprises providing the sleeve with resin for securing the oversized portion of the cable within the sleeve.

10. The method of claim 8, wherein the providing step comprises injecting a two-component resin into the bore adjacent the oversized portion of the cable.

11. The method of claim 8, further including the step of mechanically connecting the cable to the sleeve.

12. The method of claim 8, wherein the providing step comprises providing the sleeve having a dimension in at least one direction that is greater than a diameter of the borehole.

13. The method of claim 8, wherein the inserting step comprises engaging the sleeve engages one or more sides of the borehole.

14. A method of providing passive support for a face of a mine passage, comprising: providing a bolting apparatus including a sleeve having a bore with an open end adapted for receiving an oversized portion of a cable, said bore including resin for securing the cable at least partially within the sleeve; and after the delivering step, installing the sleeve at least partially within the borehole without applying tensioning to the bolting apparatus; wherein the sleeve includes a flange having a face adapted for engaging a support surface adjacent the borehole when a portion of the sleeve including corners is positioned in the borehole.

15. The method of claim 14, wherein the installing step comprises engaging the sleeve with one or more sides of the borehole.

16. The method of claim 14, further including the step of providing the sleeve having a closed end forming an endwall of the bore.

17. The method of claim 14, wherein the sleeve lacks threading for use in tensioning the cable in the borehole.

* * * * *